US005092741A

United States Patent [19]

Taguchi

[11] Patent Number: 5,092,741

[45] Date of Patent: Mar. 3, 1992

[54] SLANT PLATE TYPE COMPRESSOR WITH VARIABLE DISPLACEMENT MECHANISM

[75] Inventor: Yukihiko Taguchi, Maebashi, Japan

[73] Assignee: Sanden Corporation, Japan

[21] Appl. No.: 425,023

[22] Filed: Oct. 23, 1989

[30] Foreign Application Priority Data

Oct. 24, 1988 [JP] Japan ..... 63-266139

[51] Int. Cl.[5] ..... F04B 49/00

[52] U.S. Cl. ..... 417/222 R; 417/270

[58] Field of Search ..... 417/222, 222.5, 270; 91/505, 506; 92/12.2

[56] References Cited

U.S. PATENT DOCUMENTS

| | | | |
|---|---|---|---|
| 4,533,299 | 8/1985 | Swain et al. | 417/222.5 |
| 4,621,983 | 11/1986 | Thomas et al. | 417/222.5 |
| 4,702,677 | 10/1987 | Takenara et al. | 417/222.5 |
| 4,732,544 | 3/1988 | Kurosawa et al. | 417/222.5 |
| 4,875,832 | 10/1989 | Suzuki et al. | 417/222.5 |

FOREIGN PATENT DOCUMENTS

| | | | |
|---|---|---|---|
| 2019043 | 10/1979 | United Kingdom | 417/222.5 |

*Primary Examiner*—Richard A. Bertsch

*Assistant Examiner*—Charles G. Freay

*Attorney, Agent, or Firm*—Banner, Birch, McKie & Beckett

[57] ABSTRACT

A slant plate type compressor with a capacity or displacement adjusting mechanism is disclosed. The compressor includes a housing having a cylinder block provided with a plurality of cylinders and a crank chamber. A piston is slidably fitted within each of the cylinders and is reciprocated by a drive mechanism which includes a member having a surface with an adjustable incline angle. The incline angle is controlled by the pressure in the crank chamber. The pressure in crank chamber is controlled by control mechanism which comprises a passageway communicating between the crank chamber and a suction chamber, a first valve device to control the closing and opening of the passageway and a second valve device to control pressure in an actuating chamber. The first valve device includes a bellows valve element and a valve shifting element. The valve shifting element of which one end is exposed in the actuating chamber is coupled to the bellows to apply a force to the bellows at another end and thereby shift a control point of the bellows in response changes in the actuating chamber pressure.

31 Claims, 8 Drawing Sheets

SLANT PLATE TYPE COMPRESSOR WITH VARIABLE DISPLACEMENT MECHANISM

BACKGROUND OF THE INVENTION

1. Technical Field

The present invention relates to a refrigerant compressor, and more particularly, to a slant plate type compressor, such as a wobble plate type compressor, with a variable displacement mechanism suitable for use in an automotive air conditioning system.

2. Description of the Prior Art

It has been recognized that it is desirable to provide a slant plate type piston compressor with a displacement or capacity adjusting mechanism to control the compression ratio in response to demand. As disclosed in U.S. Pat. No. 4,428,718, the compression ratio may be controlled by changing the slant angle of the sloping surface of a slant plate in response to the operation of a valve control mechanism. The slant angle of the slant plate is adjusted to maintain a constant suction pressure in response to a change in the heat load of the evaporator of an external circuit including the compressor or a change in rotation speed of the compressor.

In an air conditioning system, a pipe member connects the outlet of an evaporator to the suction chamber of the compressor. Accordingly, a pressure loss occurs between the suction chamber and the outlet of the evaporator which is directly proportional to the suction flow rate therebetween as shown in FIG. 10. As a result, when the capacity of the compressor is adjusted to maintain a constant suction chamber pressure in response to appropriate changes in the heat load of the rotation speed of the compressor, the pressure at the evaporator outlet. increases. This increase in evaporator outlet pressure results in an undesirable decrease in the heat exchange ability of the evaporator.

Above-mentioned U.S. Pat. No. 4,428,718 discloses a valve control mechanism to eliminate this problem. The valve control mechanism, which is responsive to both suction and discharge pressure, provides controlled communication of both suction and discharge fluid with the compressor crank chamber and thereby controls compressor displacement. The compressor control point for displacement change is shifted to maintain a nearly constant pressure at the evaporator outlet portion by means of this compressor displacement control. The valve control mechanism makes use of the fact that the discharge pressure of the compressor is roughly directly proportional to the suction flow rate.

However, in the above-mentioned valve control mechanism, a single movable valve member, formed of a number of parts, is used to control the flow of fluid both between the discharge chamber and the crankcase chamber, and between the crankcase chamber and the suction chamber. Thus, extreme precision is required in the formation of each part and in the assembly of the large number of parts into the control mechanism in order to attempt to assure that the valve control mechanism operates properly. Furthermore, when the heat load of the evaporator or the rotation speed of the compressor is changed quickly, discharge chamber pressure increases and an excessive amount of discharge gas flows into the crank chamber from the discharge chamber through a communication passage of the valve control mechanism due to a lag time to such the action between the operation of the valve control mechanism and the response of the external circuit including the compressor. As a result of the excessive amount of discharge gas flow, a decrease in compression efficiency of the compressor and a decline of durability of the compressor internal parts occurs.

To overcome the above-mentioned disadvantage, Japanese Patent Application Publication No. 1-142276 proposes a slant plate type compressor with the varaible displacement mechanism which is developed to take advantage of the relationship between discharge pressure and suction flow rate. That is, the valve control mechanism of this Japanese '276 publication is designed to have a simple physical structure and to operate in a direct manner on a valve controlling element in response to discharge pressure changes, thereby resolving the complexity, excessive discharge flow and slow response time problems of the prior art.

However, in the both U.S. '718 Patent and Japanese '276 publication, the valve control mechanism maintains pressure in the evaporator outlet at the certain valve by means of compensating the pressure loss occurring between the evaporator outlet and the compressor suction chamber in direct response to pressure in the compressor discharge chamber as shown in FIG. 9. Accordingly, a valve of compensating the pressure loss is determined by a value of the discharge chamber pressure with one correspondence, that is, only one value of compensating the pressure loss corresponds to only one value of the discharge chamber pressure. Furthermore, when the displacement of the compressor is controlled in response to characteristic of an automotive air conditioning system, such as, the temperature of passenger compartment air or the temperature of air leaving from the evaporator in addition to the change in the heat load of the evaporator or the change in rotation speed of the compressor to operate the automotive air conditioning system more elaborately, it is required to flexibly compensate the pressure loss. Therefore, the above-mentioned technique of the prior art regarding the compensation for the pressure loss is not suited to the elaborate operation of the automotive air conditioning system.

SUMMARY OF THE INVENTION

Accordingly, it is an object of this invention to provide a slant plate type piston compressor having a capacity adjusting mechanism, which compensates the pressure loss, for suitable use in an elaborately operated automotive air conditioning system.

A slant plate type compressor in accordance with the present invention preferably includes a compressor housing having a front end plate at one of its ends and a rear end plate at its other end. A crank chamber and a cylinder block are preferably located in the housing and a plurality of cylinders are formed in the cylinder block. A piston is slidably fit within each of the cylinders and is reciprocated by a driving mechanism. The driving mechanism preferably includes a drive shaft, a drive rotor coupled to the drive shaft and rotatable therewith, and a coupling mechanism which drivingly couples the rotor to the pistons such that the rotary motion of the rotor is converted to reciprocating motion of the pistons. The coupling mechanism includes a member which has a surface disposed at an incline angle to the drive shaft. The incline angle of the member is adjustable to vary the stroke length of the reciprocating pistons and, thus, vary the capacity or displacement of the compressor. A rear end plate preferably surrounds a suction chamber and a discharge chamber. A first passageway provides fluid communication between the crank chamber and the suction chamber. An incline angle control device is supported in the compressor and controls the incline angle of the coupling mechanism member in response to the pressure condition in the compressor.

A first valve control mechanism includes a valve element opening and closing of the first passageway and a shifting element shifting the control point of the valve element in response to pressure changes in an actuating chamber by applying a force to the valve element.

A control point shifting mechanism can also include a second valve control mechanism varying pressure in the actuating chamber from the discharge chamber pressure to an appropriate pressure.

Further objects, features and other aspects of the invention will be understood from the detailed description of the preferred embodiments of this invention with reference to the drawings.

DETAILED DESCRIPTION OF THHE PREFERRED EMBODIMENTS

Figure 1:
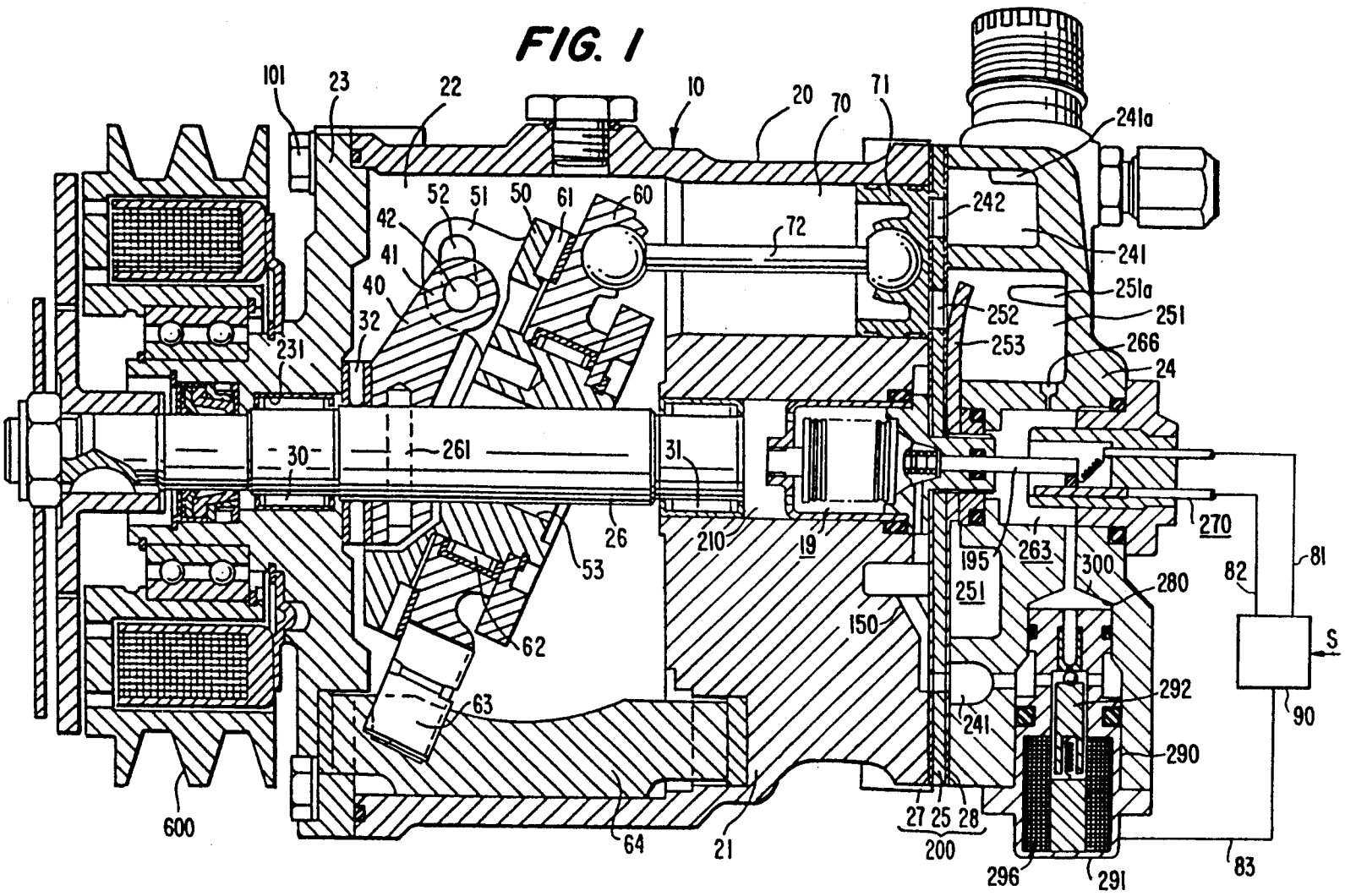
FIG. 1 is a vertical longitudinal sectional view of a wobble plate type refrigerant compressor in accordance with a first embodiment of the present invention.

With reference to FIG. 1, the construction of a slant plate type compressor, specifically a wobble plate type refrigerant compressor 10 in accordance with a first embodiment of the present invention is shown. Compressor 10 of FIG. 1 includes cylindrical housing assembly 20 having cylinder block 21, front end plate 23 at one end of cylinder block 21, crank chamber 22 formed between cylinder block 21 and front end plate 23, and rear end plate 24 attached to the other end of cylinder block 21. Front end plate 23 is mounted on cylinder block 21 forward (to the left in FIG. 1) of crank chamber 22 by plurality of bolts 101. Rear end plate 24 is mounted on cylinder block 21 at its opposite end by plurality of bolts (not shown). Valve plate 25 is located between rear end plate 24 and cylinder block 21. Opening 231 is centrally formed in front end plate 23 for supporting drive shaft 26 by bearing 30 disposed in opening 231. The inner end portion of drive shaft 26 is rotatably supported by bearing 31 disposed within central bore 210 of cylinder block 21. Bore 210 extends to a rearward end surface of cylinder block 21 to receive first valve control mechanism 19 as described in detail below.

Cam rotor 40 is fixed on drive shaft 26 by pin member 261 and rotates with shaft 26. Thrust needle bearing 32 is disposed between the inner end surface of front end plate 23 and the adjacent axial end surface of cam rotor 40. Cam rotor 40 includes arm 41 having pin member 42 extending therein.

Slant plate 50 is adjacent cam rotor 40 and includes opening 53 through which passes drive shaft 26. Slant plate 50 includes arm 51 having slot 52. Cam rotor 40 and slant plate 50 are connected by pin member 42, which is inserted in slot 52 to create a hinged joint. Pin member 42 is suitably disposed within slot 52 to allow adjustment of the angular position of slant plate 50 with respect to the longitudinal axis of drive shaft 26.

Wobble plate 60 is rotatably mounted on slant plate 50 through bearing 61 and 62. Fork shaped slider 63 is attached to the outer peripheral end of wobble plate 60 and is suitably mounted on sliding rail 64 held between front end plate 23 and cylinder block 21. Fork shaped slider 63 prevents rotation of wobble plate 60 and wobble plate 60 nutates along rail 64 when cam rotor 40 rotates. Cylinder block 21 includes a plurality of peripherally located cylinder chambers 70 in which pistons 71 reciprocate. Each piston 71 is connected to wobble plate 60 by a corresponding connecting rod 72.

Rear end plate 24 includes peripherally located annular suction chamber 241 and centrally located discharge chamber 251. Valve plate 25 is located between cylinder block 21 and rear end plate 24 and includes a plurality of valved suction ports 242 linking suction chamber 241 with respective cylinders 70. Valve plate 25 also includes a plurality of valved discharge ports 252 linking discharge chamber 251 with respective cylinders 70. Suction ports 242 and discharge ports 252 are provided with suitable reed valves as described in U.S. Pat. No. 4,011,029 to Shimizu.

Suction chamber 241 includes inlet portion **241*a* which is connected to an evaporator of the external cooling circuit (not shown). Discharge chamber 251 is provided with outlet portion 251*a*** connected to a condenser of the cooling circuit (not shown).

Gaskets 27 and 28 are located between cylinder block 21 and the inner surface of valve plate 25, and the outer surface of valve plate 25 and rear end plate 24 respectively, to seal the mating surface of cylinder block 21, valve plate 25 and rear end plate 24.

Figure 2:
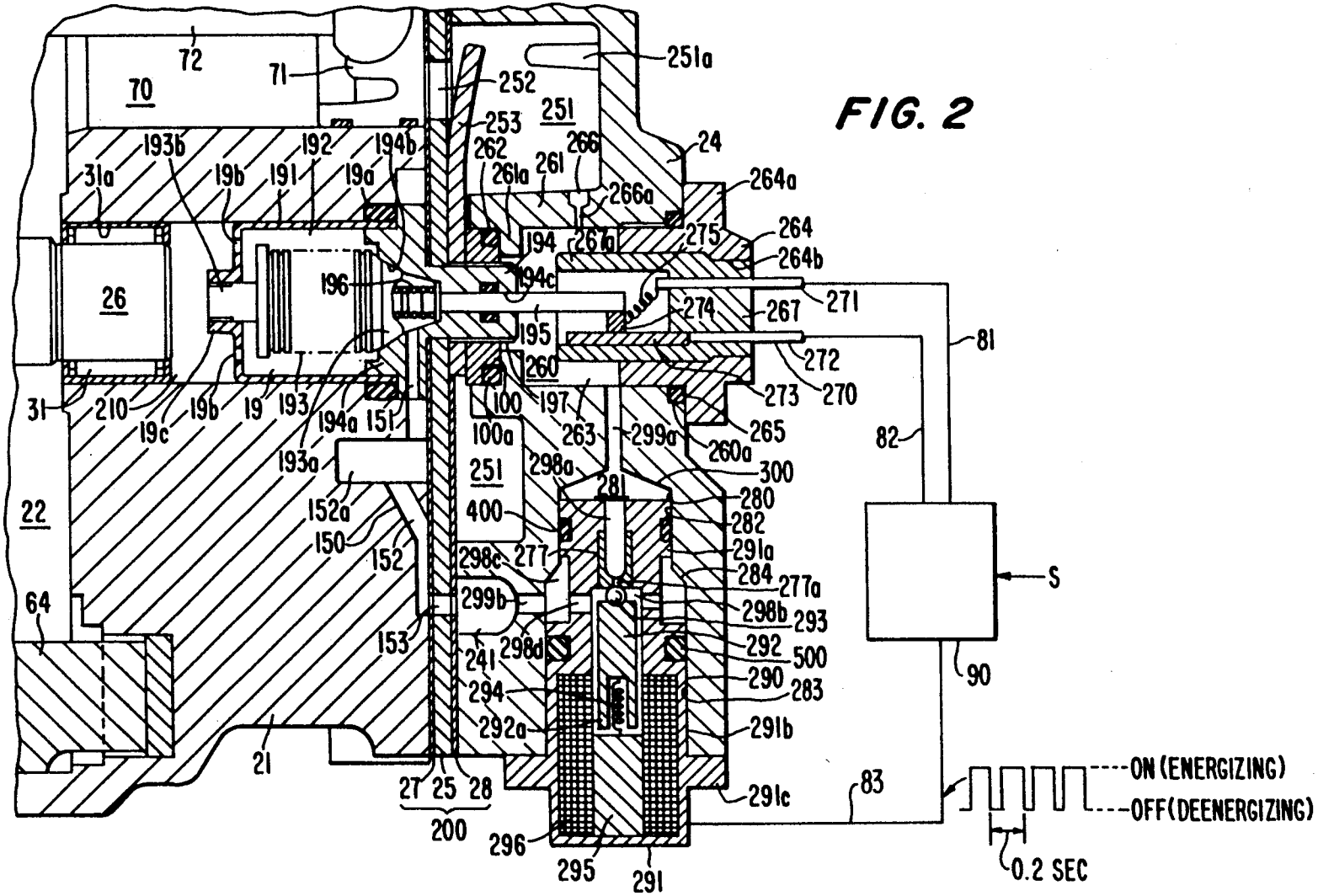
FIG. 2 is an enlarged partially sectional view of first and second valve control mechanisms shown in FIG. 1.

With reference to FIG. 2, first valve control mechanism 19 includes cup-shaped casing member 191 defining valve chamber 192 therewithin. O-ring **19*a* is disposed between an outer surface of casing member 191 and an inner surface of bore 210 to seal the mating surface of casing member 191 and cylinder block 21. A plurality of holes 19*b* are formed at a closed end (to the left in FIG. 2) of casing member 191 to lead crank chamber pressure into valve chamber 192 through a gap 31*a* existing between bearing 31 and cylinder block 21. Bellows 193 is disposed in valve chamber 192 to longitudinally contract and expand in response to crank chamber pressure. Projection member 193*b* attached at a forward (to the left in FIG. 2) end of bellows 193 is secured to axial projection 19*c* formed at a center of closed end of casing member 191. Valve member 193*a* is attached at a rearward (to the right in FIG. 2) end of bellows 193**.

Cylinder member 194 including valve seat 194*a* penetrates a center of valve plate assembly 200 which includes valve plate 25, gaskets 27 and 28, suction valve member (not shown) and discharge valve member (not shown). Valve seat 194*a* is formed at a forward end of cylinder member 194 and is secured to an opened end of casing member 191. Nut 100 including annular cut-out portion 100*a* formed at an outer peripheral surface of a rear end thereof is screwed on cylinder member 194 from a rearward end of cylinder member 194 to fix cylinder member 194 to valve plate assembly 200 with valve retainer 253. This rearward end of cylinder member 194 is located in acutating chamber 263.

Conical shaped opening 194*b* of cylinder member 194 receives valve member 193*a* and is formed at valve seat 194*a*. This opening 194*b* is linked to cylinder 194*c* which is axially formed in cylinder member 194. Actuating rod 195 is slidably disposed within cylinder 194*c*, projected from the rearward end of cylinder 194*c*, and linked to valve member 193*a* through bias spring 196. O-ring 197 is disposed between an inner surface of cylinder 194*c* and outer surface of actuating rod 195 to seal the mating surface of cylinder 194*c* and actuating rod 195.

Radial hole 151 is formed at valve seat 194*a* to link conical shaped opening 194*b* to one end opening of conduit 152 formed at cylinder block 21. Conduit 152 includes cavity 152*a* and also links to suction chamber 241 through hole 153 formed at valve plate assembly 200. Passageway 150, which provides communication between crank chamber 22 and suction chamber 241, is obtained by uniting gap 31*a*, bore 210, holes 19*b*, valve chamber 192, conical shaped opening 194*b*, radial hole 151, conduit 152 and hole 153. As a result, the opening and closing of passageway 150 is controlled by the contracting and expanding of bellows 193 in response to crank chamber pressure.

Annular projection 261 projecting forward (to the left in FIG. 2) is formed at an inner surface of rear end plate 24 to define axial cylindrical cavity 260. Annular projection 261 includes annular flange 261*a* formed at an inner peripheral surface of a near forward end thereof. O-ring 262 is disposed between annular cut-out portion 100*a* of nut 100 and annular flange 261*a* to insulate discharge chamber 251 and actuating chamber 263.

Plug member 264 having annular flange 264*a* formed at an outer peripheral surface of a near rear end thereof is preferably screwed into an inner peripheral surface of axial cylindrical cavity 260 to define actuating chamber 263. O-ring 265 is disposed between annular cut-out portion 260*a* formed at a rear end of axial cylindrical cavity 260 and annular flange 264*a* to insulate actuating chamber 263 and an outside of the compressor.

Conduit or passageway 266 including throttled portion 266*a* is formed at annular projection 261 to link discharge chamber 251 to actuating chamber 263. Plug member 264 further includes central hole 264*b* at which cylindrical element 267 of insulating material, for example, polyimide resin, is fixedly disposed. Cylindrical element 267 further includes annular projection 267*a* forward integrated thereon with surrounding actuating rod 195. Cylindrical element 267 is provided with positive and negative electrodes 271 and 272, both of which are fixedly disposed therewithin. A rearward end of negative electrode 272 is exposed on the outside of the compressor and is connected to control unit 90 through wire 82. A forward end of negative electrode 272 is connected to plate 273 of electrical resistance, for example, Ni-Cu alloy, attached to an inner surface of annular projection 267*a*. A rearward end of positive electrode 271 is exposed on the outside of the compressor and is connected to control unit 90 through wire 81. A forward end of positive electrode 271 is exposed in actuating chamber 263 and is connected to chip 274 through coiled wire 275. Chip 274 of electric conductor, for example, phosphor bronze, is insulatedly attached to a rear end of actuating rod 195 so as to axially slide on plate 273 in accordance with an axial motion of actuating rod 195. Consequentially, the axial movement of actuating rod 195 corresponds with the axial movement of chip 274. Therefore, positive and negative electrodes 271 and 272, plate 273, chip 274 and coiled wire 275 constitute potentiometer 270. Accordingly, an axial location of actuating rod 195 substantially representing a control point of suction chamber pressure is sensed by potentiometer 270. Potentiometer 270 sends a signal indicating the control point of suction chamber pressure to control unit 90 through wires 81 and 82.

Radial cylindrical cavity 280 is radially formed at rear end plate 24 to dispose second valve control mechanism 290 therewithin. From the radial inner end to the radial outer end, radial cylindrical cavity 280 includes conical cavity portion 281, small diameter cavity portion 282 and large diameter cavity portion 283 in order. Small diameter cavity portion 282 is connected to large diameter cavity portion 283 through annular slanted surface 284.

Second valve control mechanism 290 includes cup-shaped casing 291 having small diameter casing portion 291*a* of a diameter slightly smaller than the diameter of small diameter cavity portion 282. The cup-shaped casing 291 also has large diameter casing portion 291*b* of a diameter slightly smaller than large diameter cavity portion 283. Annular flange 291*c* is formed at a near rearward (to the bottom in FIG. 2) end of large diameter casing portion 291*b*.

Cup-shaped casing 291 is inserted into second cylindrical cavity 280 until, preferably, it contacts a forward end surface of annular flange 291*c* to the radial outer of second cylindrical cavity 280 so as to fit small and large diameter casing portions 291*a* and 291*b* within small and large diameter cavity portions 282 and 283 respectively. Rod 292 fixedly attaching ball element 293 at a forward end thereof is disposed within large diameter casing portion 291*b*. Annular projection 292*a* is projected from a rearward end of rod 292 so as to surround bias spring 294 disposed between the rearward end of rod 292 and a forward end of pedestal 295 which is fixedly disposed on an inner surface of a rearward end of cup-shaped casing 291. Bias spring 294 pushes rod 292 forward in virtue of restoring force thereof. Solenoid 296 is disposed on the inner surface of the rearward end of cup-shaped casing 291 so as to substantially surround rod 292.

Valve seat 277 having hole 277*a* is fixedly disposed within a rearward end of small diameter casing portion 291*a*. Hole 277*a* links axial cavity 298*a* of small diameter casing portion 291*a* to axial cavity 298*b* of large diameter casing portion 291*b*. Annular cavity 298*c* formed at an outer peripheral surface of casing 291 is located in a border between small and large diameter casing portions 291*a* and 291*b*. A plurality of radial hole 298*d* are formed at the border between small and large diameter casing portions 291*a* and 291*b* to link axial cavity 298*b* of large diameter casing portion 291*b* to annular cavity 298*c*. Conduit 299*a* is formed at a near radial center of rear end plate 24 so as link actuating chamber 263 to conical cavity portion 281. Conduit 299*b* is formed at a near radial outer portion of rear end plate 24 so as to link suction chamber 241 to annular cavity 298*c*. Accordingly, passageway 300 linking actuating chamber 263 to suction chamber 241 is constituted by conduit 299*a*, conical cavity portion 281 of cavity 280, axial cavity 298*a*, hole 277*a*, axial cavity 298*b*, radial holes 298*d*, annular cavity 298*c* and conduit 299*b*.

Furthermore, passageway 300 and conduit 266 together link discharge chamber 251 to suction chamber 241 through actuating chamber 263. An opening area of hole 277*a* of valve seat 277 is designed to be so sized and shaped as to have the volume of the refrigerant flowing into suction chamber 241 from actuating chamber 263 to be equal to or greater than the maximum volume of the refrigerant flowing into actuating chamber 263 from discharge chamber 251.

Figure 6:
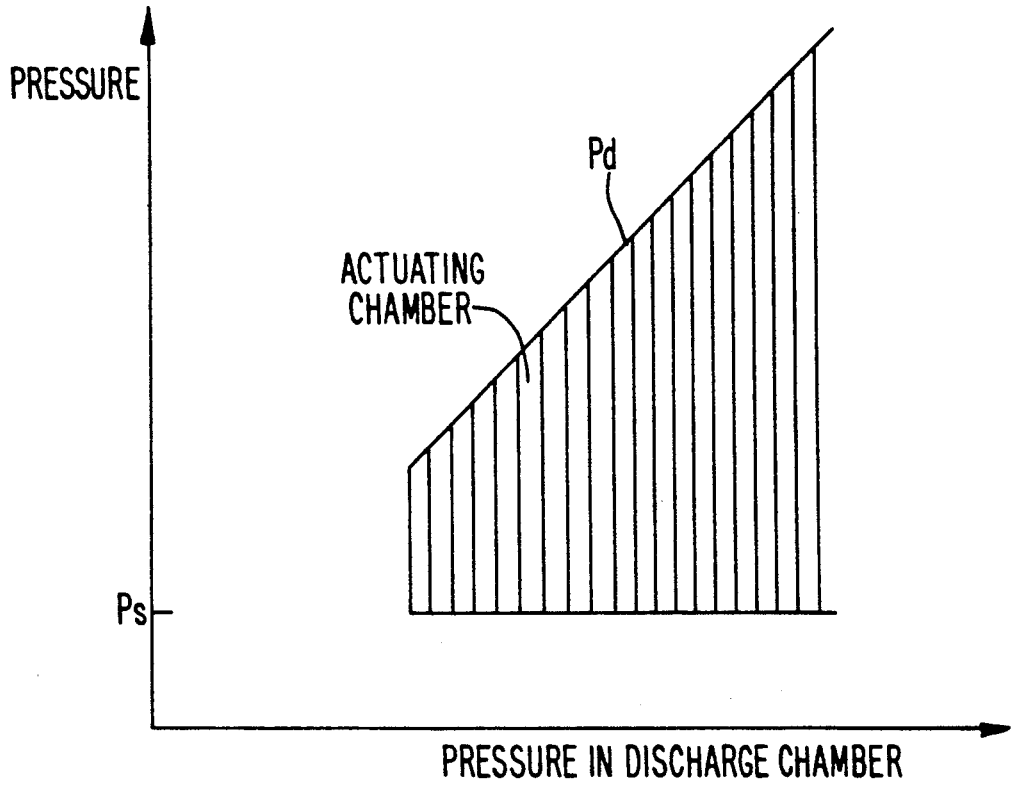
FIG. 6 a graph illustrating an operating characteristic produced by the compressor in FIGS. 1, 3 and 4.

Still furthermore, when solenoid 296 is energized, rod 292 moves rearward against restoring force of bias spring 294 to open hole 277*a*. As a result, the discharge gas conducted into actuating chamber 263 through conduit 266 flows into suction chamber 241 through passageway 300, thereby there being decreased pressure in actuating chamber 263 relative to the suction chamber 241 pressure. On the other hand, when solenoid 296 is deenigized, rod 292 moves forward in virtue of restoring force of bias spring 294 to close hole 277*a*. As a result, actuating chamber 263 fills with discharge gas conducted through conduit 266, thereby there being increased pressure in actuating chamber 263 relative to the discharge chamber 251 pressure. Consequently, pressure in actuating chamber 263 can be freely varied from discharge chamber 251 pressure Pd to suction chamber 241 pressure Ps by varying the ratio of solenoid 296 energizing time to solenoid deenergizing time, defined in a very short period of time, as shown in FIG. 6.

Also in FIG. 2, O-ring 400 is disposed between an outer peripheral surface of small diameter casing portion 291*a* and an inner peripheral surface of small diameter cavity portion 282 to seal the mating surface of the large diameter casing portion 291*b* and an inner peripheral surface of large diameter cavity portion 283 to seal the mating surface therebetween. Wire 83 connects solenoid 296 to control unit 90.

During operation of compressor 10 of FIGS. 1 and 2, drive shaft 26 is rotated by the engine of the vehicle, preferably through an electromagnetic clutch 600. Cam rotor 40 is rotated with drive shaft 26. This causes rotating of slant plate 50 as well, which causes wobble plate 60 to nutate. Notational motion of wobble plate 60 reciprocates pistons 71 in their respective cylinders 70. As pistons 71 are reciprocated, refrigerant gas which is introduced into suction chamber 241 through inlet portion 241*a*, flows into each cylinders 70 through suction ports 242 and then compressed. The compressed refrigerant gas is discharged to discharge chamber 251 from each cylinder 70 through discharge ports 252, and therefrom into the cooling circuit through outlet portion 251*a*.

The capacity of compressor 10 is adjusted to maintain a constant pressure in suctiuon chamber 241 in response to a change in the heat load of the evaporator or a change in the rotating speed of the compressor. The capacity of the compressor is adjusted by changing the angle of the slant plate which is dependent upon the crank chamber pressure. An increase in crank chamber pressure decreases the slant angle of the slant plate and the wobble plate and, thus, decreases the capacity of the compressor. A decrease in the crank chamber pressure increases the angle of the slant plate and the wobble plate and, thus, increases the capacity of the compressor.

The combined effect of the first and second valve control mechanisms of the present invention is to maintain a constant pressure at the outlet of the evaporator during capacity control of the compressor in the following manner.

When control unit 90 receives the signal indicating the air conditioning condition, such as, the temperature of the passenger compartment air or the temperature of air leaving from the evaporator as shown by arrow S in FIGS. 1 and 2, and the signal indicating the control point of suction chamber pressure sensed by potentiometer 270, control unit 90 determines whether the control point of suction chamber pressure is changed or not on the basis of these two signals. This determination is made to maintain pressure at the outlet of the evaporator at a certain value. Then, control unit 90 sends a control signal, which indicates the ratio of solenoid 296 energizing time to solenoid deenergizing time, defined in a very short period of time. As shown in FIG. 2, this control signal to second valve control mechanism 290 enables this second valve control mechanism 290 to control the pressure in actuating chamber 263 from the discharge chamber 251 pressure to the suction chamber 241 pressure.

Figure 8:
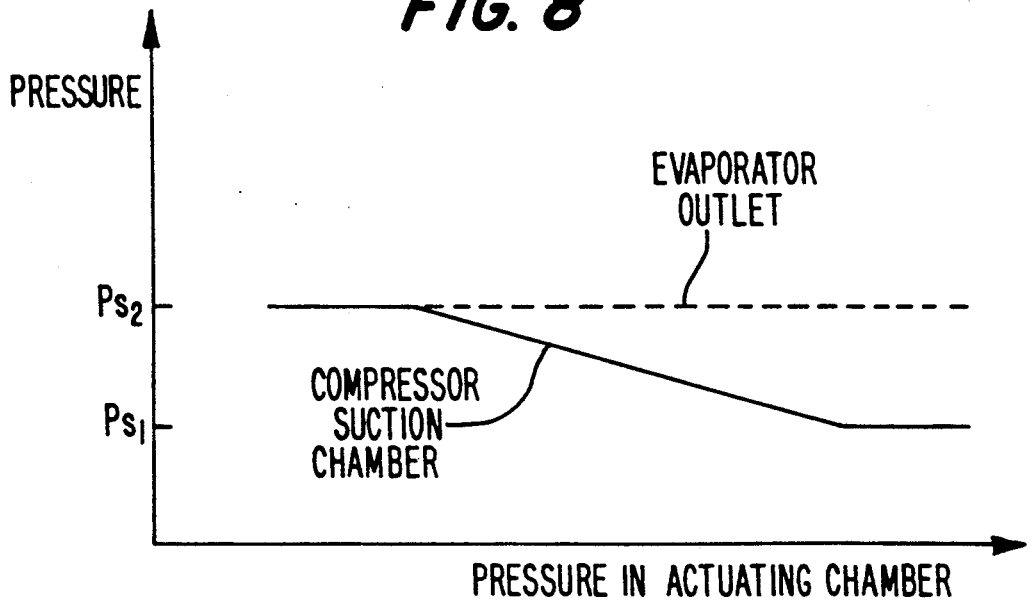
FIG. 8 a graph illustrating an operating characteristic produced by the compressor in FIGS. 1, 3, 4 and 5.

Actuating rod 195 pushes valve member 193*a* in the direction to contract bellows 193 through bias spring 196, which smoothly transmits the force form actuating rod 195 to valve member 193*a* of bellows 193. Actuating rod 195 is moved in response to receiving pressure in actuating chamber 263. Accordingly, increasing pressure in actuating chamber 263 further moves rod 195 toward bellows 193, thereby increasing the tendency to contract bellows 193. As a result, pressure in suction chamber 241 is changed from Ps1 to Ps2. Consequentially, the pressure loss is compensated, thereby maintaining a constant pressure at the evaporator outlet portion as shown in FIG. 8. Since actuating rod 195 moves in response to changes in pressure in actuating chamber 263 and applies a force directly to bellows 193 (the controlling valve element), the control point at which bellows 193 operates is shifted in a very direct and responsive manner by changes in the pressure in actuating chamber 263.

Figure 3:
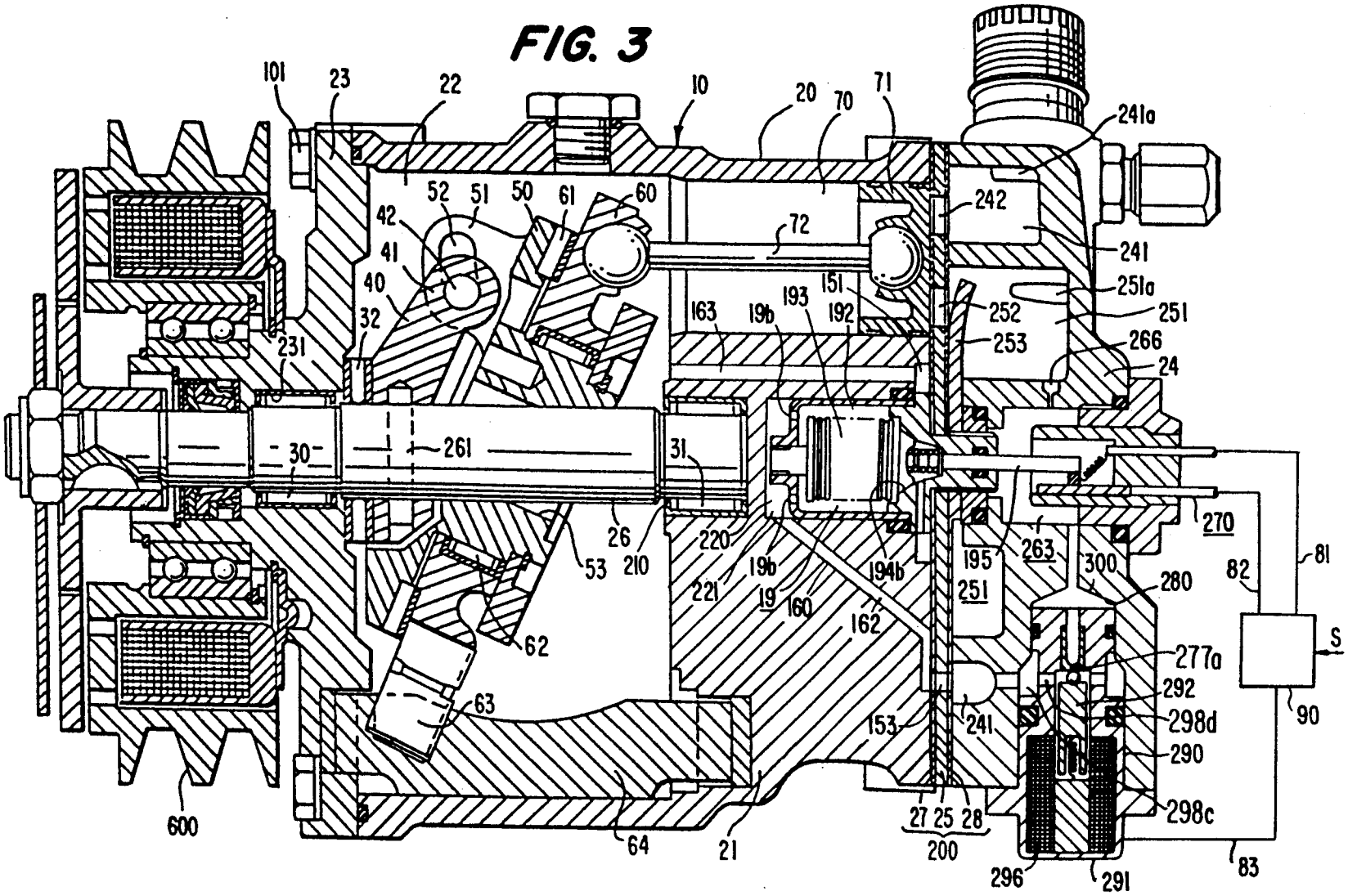
FIG. 3 is a vertical longitudinal sectional view of a wobble plate type refrigerant compressor in accordance with a second embodiment of the present invention.

FIG. 3 illustrates a second embodiment of the present invention in which the same numerals are used to denote the same elements shown in FIGS. 1 and 2. In the second embodiment, cavity 220, in which is disposed first valve control mechanism 19, is formed at a central portion of cylinder block 21 and is isolated from bore 210 which rotatably supports drive shaft 26. Holes 19*b* link valve chamber 192 to space 221 provided at the forward end of cavity 220. Conduit 162, linking space 221 to suction chamber 241 through hole 153, is formed in cylinder block 21 to lead suction chamber pressure into space 221. Conduit 163 linking crank chamber 22 to radial hole 151, is also formed in cylinder block 21. Passageway 160 communicating crank chamber 22 and suction chamber 241 is, thus, obtained by uniting conduit 163, radial hole 151, conical shaped opening 194*b*, valve chamber 192, holes 19*b*, space 221, conduit 162 and hole 153. As a result, the opening and closing of passageway 160 is controlled by the contracting and expanding of bellows 193 in response to suction chamber pressure.

Figure 4:
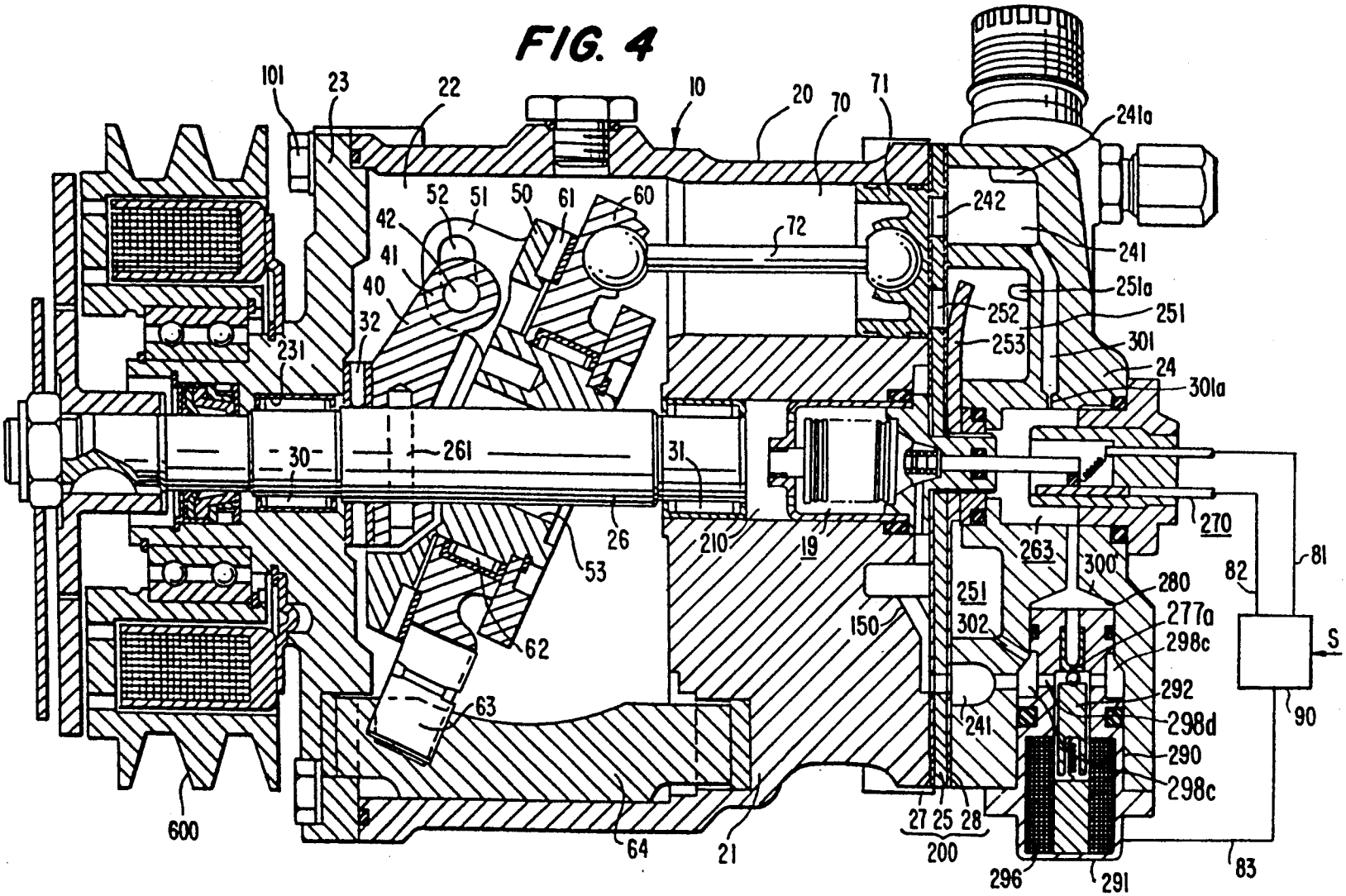
FIG. 4 is a vertical longitudinal sectional view of a wobble plate type refrigerant compressor in accordance with a third embodiment of the present invention.

FIG. 4 illustrates a third embodiment of the present invention in which the same numerals are used to denote the same elements shown in FIGS. 1 and 2. In third embodiment, conduit 301 including throttled portion 301*a* is formed at rear end plate 24 to link actuating chamber 263 to suction chamber 241. Conduit 302 is formed at a near radial center of rear end plate 24 to link discharge chamber 251 to annular cavity 298*c*. Furthermore, an opening area of throttled portion 301*a* is designed to be so sized and shaped as to equalize pressure in actuating chamber 263 relative to the discharge chamber pressure, when hole 277*a* is opened by energizing solenoid 296, that is, communication of passageway 300' linking actuating chambwer 263 to discharge chamber 251 is obtained.

Figure 5:
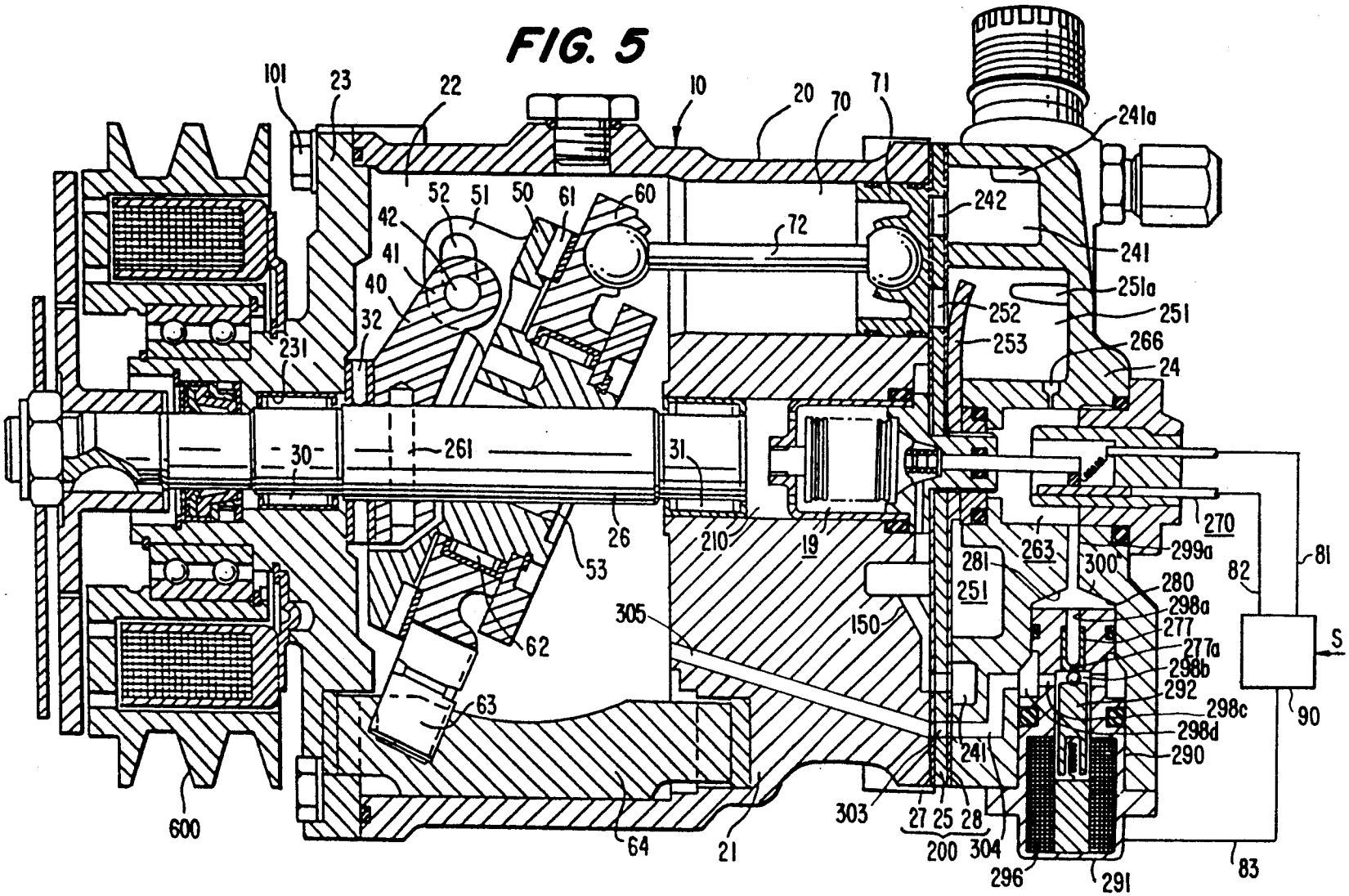
FIG. 5 is a vertical longitudinal sectional view of a wobble plate type refrigerant compressor in accordance with a fourth embodiment of the present invention.

FIG. 5 illustrates a fourth embodiment of the present invention in which the same numerals are used to denote the same elements shown in FIGS. 1 and 2. In the fourth embodiment, conduit 304 is formed at a near radial outer portion of rear end plate 24 to link annular cavity 298*c* to hole 303 formed at valve plate assembly 200. Conduit 305 is formed at cylinder block 21 to link hole 303 to crank chamber 22. Therefore, passageway 300'' linking actuating chamber 263 to crank chamber 22 is constituted by conduit 299*a*, conical cavity portion 281, axial cavity 298*a*, hole 277*a*, axial cavity 298*b*, radial holes 298*d* annular cavity 298*c*, conduit 304, hole 303 and conduit 305.

Figure 7:
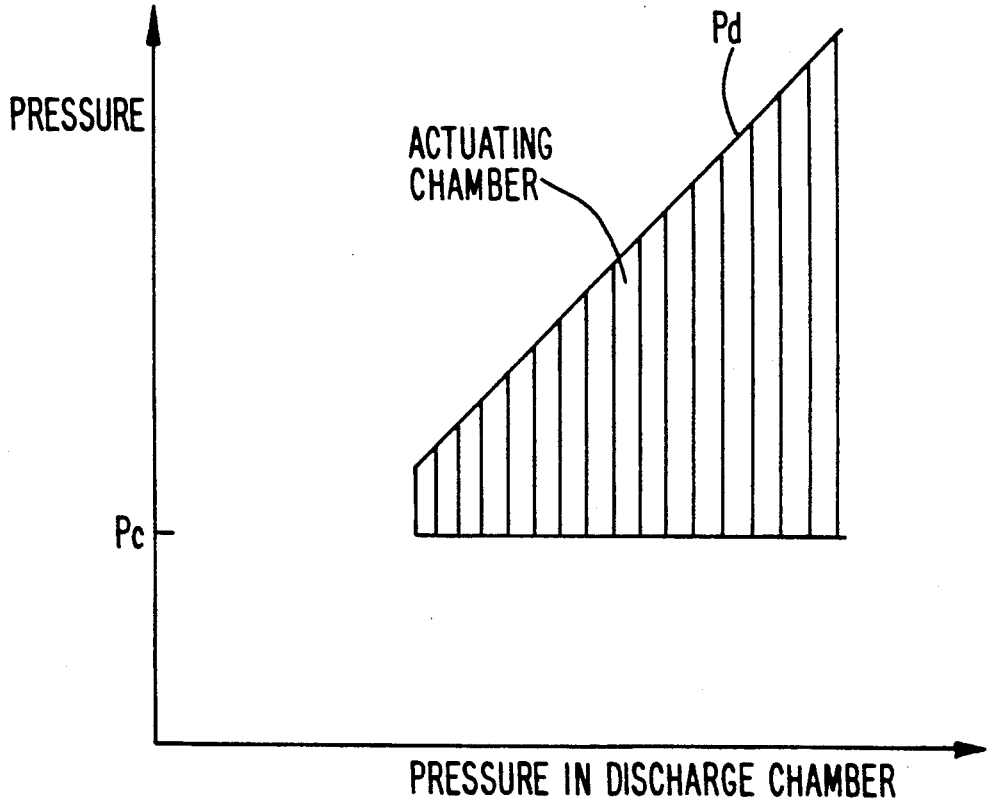
FIG. 7 a graph illustrating an operating characteristic produced by the compressor in FIG. 5.
Figure 9:
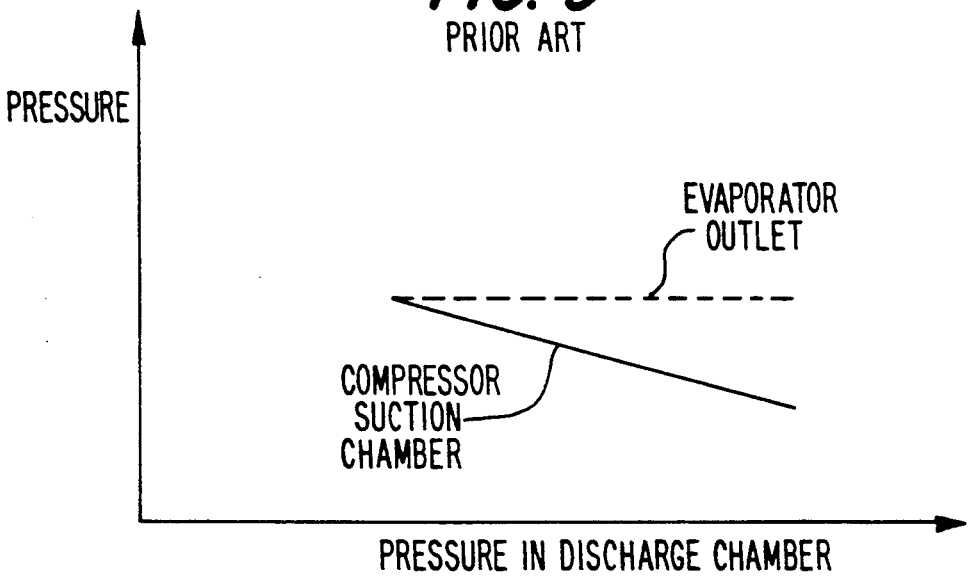
FIG. 9 PRIOR ART
FIG. 9 is a graph illustrating an operating characteristic produced by the compressor in the prior art.
Figure 10:
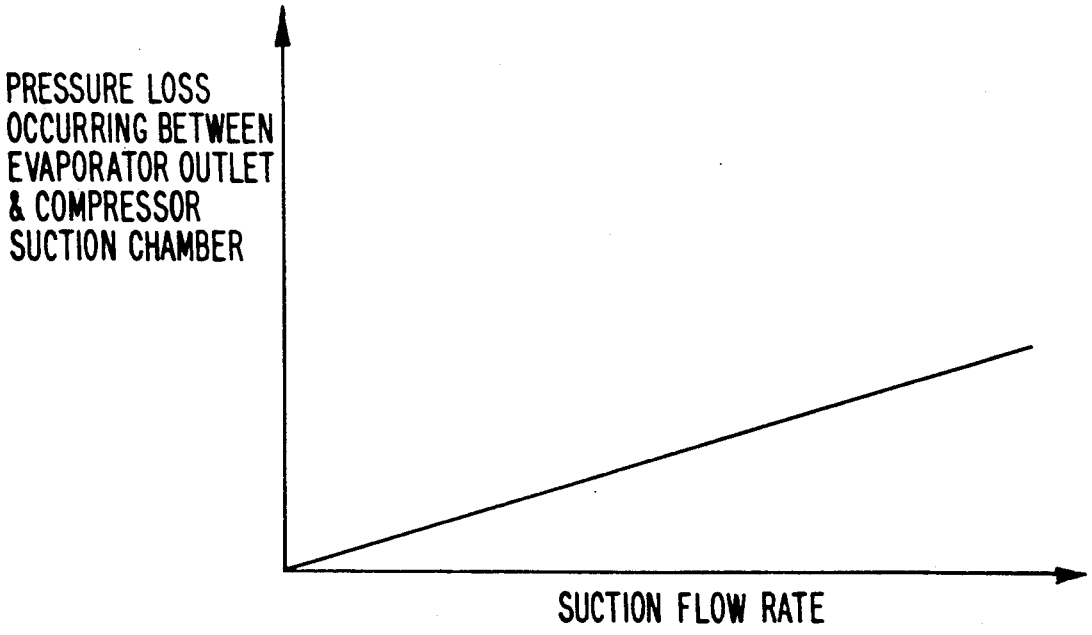
FIG. 10 is a graph showing the relationship between the pressure loss occurring between the evaporator outlet portion and the compressor suction chamber to the suction flow rate.

An opening area of hole 277*a* of valve seat 277 is designed to be so sized and shaped as to have the volume of the refrigerant flowing into crank chamber 22 from actuating chamber 263 to be equal to or greater than the maximum volume of the refrigerant flowing into actuating chamber 263 from discharge chamber 251. Accordingly, pressure in actuating chamber 263 can be freely varied from discharge chamber pressure Pd to crank chamber pressure Pc by varying the ratio of solenoid energizing time to solenoid deenerizing time, defined in a very short period of time as shown in FIG. 7.

FIGS. 1-5 illustrate a capacity adjusting mechanism used in a wobble plate type compressor. As is typical in this type of compressor, the wobble plate is disposed at a slant or incline angle relative to the drive shaft axis, nutates but does not rotate, and drivingly couples the pistons to the drive source. This type of capacity adjusting mechanism, using selective fluid communication between the crank chamber and the suction chamber, however, can be used in any type of compressor which uses a slanted plate or surface in the drive mechanism. For example, U.S. Pat. No. 4,664,604, issued to Terauchi, discloses this type of capacity adjusting mechanism in a swash plate type compressor. The swash plate, like the wobble plate, is disposed at a slant angle and drivingly couples the pistons to the drive source. However, while the wobble plate only nutates, the swash plate both nutates and rotates. The term slant plate type compressor is therefore used to refer to any type of compressor, including wobble and swash plate types, which use a slanted plate or surface in the drive mechanism.

This invention has been described in connection with the preferred embodiments. These embodiments, however, are merely for example only and the invention is not restricted thereto. It will be understood by those skilled in the art that other variations and modifications can be easily be made within the scope of this invention as defined by the claims.

I claim:

1. In a slant plate type refrigerant compressor including a compressor housing having a cylinder block, a front end plate at one end and a rear end plate at its other end, said cylinder block provided with a plurality of cylinders and a crank chamber adjacent said cylinders, a plurality of pistons with each piston slidably fitted within each of said cylinders, a drive mechanism coupled to said pistons to reciprocate said pistons within said cylinders, said drive mechanism including a drive shaft rotatably supported in said housing, a rotor coupled to said drive shat and rotatable therewith, and coupling means for drivingly coupling said rotor to said piston such that the rotary motion of said rotor is converted into reciprocating motion of said pistons, said coupling means including a member having a surface disposed at an angle inclined relative to said drive shaft, said inclined angle of said member being adjusted to vary the stroke length of said pistons and the capacity of the compressor, said rear end plate having a suction chamber and a discharge chamber, a first passageway between said crank chamber and said suction chamber, the improvement comprising:

an actuating chamber disposed in said housing;

first valve means for controlling the closing and opening of said first passageway to vary the capacity of the compressor by adjusting the incline angle, said first valve control means including:

a valve element opening and closing said first passageway; and shifting means, having one end coupled to said valve element and another end exposed in said actuating chamber, for shifting a control point of said valve element in response to changes in pressure in said actuating chamber;

second valve means for controlling pressur ein said actuating chamber;

means for snesing the control point of said valve element;

means for detemering whether the control point of said valve element is changed or not on the basis of a sensed air conditioning condition and said sensed control point; and means for sending a control signal to said second valve control means to vary pressure in said actuating chamber.

2. The refrigerant compressor of claim 1, wherein said shifting means further comprises a second passageway linking said actuating chamber to said discharge chamber and a third passageway linking said actuating chamber to said suction chamber; and said second valve means being disposed in said third passageway and controlling the closing and opening of said third passageway to vary pressure in said actuating chamber from the discharge chamber pressure to the suction chamber pressure.

3. The refrigerant compressor of claim 2, wherein said second and third passageways are so sized and shaped to have the volume of fluid flowing into said suction chamber from said actuating chamber be equal to or greater than the maximum volume of fluid flowing into said actuating chamber from said discharge chamber.

4. The refrigerant compressor of claim 2, wherein said second passageway includes a throttled portion.

5. The refrigerant compressor of claim 1, wherein said actuating chamber is linked to both of said suction chamber and said discharge chamber via passageways and the volume of fluid flowing into said suction chamber from said actuating chamber is equal to or greater than the maximum volume of fluid flowing into said actuating chamber from said discharge chamber.

6. The refrigerant compressor of claim 1, wherein said shifting means further comprises a fourth passageway linking said actuating chamber to said suction chamber and a fifth passageway linking said actuating chamber to said discharge chamber; and said second valve means being disposed in said fifth passageway and controlling the closing and opening of said fifth passageway to vary pressure in said actuating chamber from the discharge chamber pressure to the suction chamber pressure.

7. The refrigerant compressor of claim 6, wherein said fourth passageway includes a throttled portion.

8. The refrigerant compressor of claim 7, wherein an opening area of said throttling porting is so sized and shaped as to equalize pressure in said actuating chamber relative to the discharge chamber pressure, when the communication of said fifth passageway is obtained.

9. The refrigerant compressor of claim 1, wherein said shifting means further comprises a sixth passageway linking said actuating chamber to said discharge chamber and a seveth passageway linking said actuating chamber to said crank chamber; and said second valve means being disposed in said seventh passageway and controlling the closing and opening of said seventh passageway to vary pressure in said actuating chamber from the discharge chamber pressure to the crank chamber pressure.

10. The refrigerant compressor of claim 9, wherein said sixth and seventh passageways are so sized and shaped to have the volume of fluid flowing into said crank chamber from said actuating chamber equal to or greater than the maximum volume of fluid flowing into said actuating chamber from said discharge chamber.

11. The refrigerant compressor of claim 9, wherein said sixth passageway includes a throttled portion.

12. The refrigerant compressor of claim 1, wherein said actuating chamber is linked to both of said crank chamber and said discharge chamber via passageways and the volume of fluid flowing into said crank chamber from said actuating chamber is equal to or greater than the maximum volume of fluid flowing into said actuating chamber from said discharge chamber.

13. The refrigernat compressor of claim 1, wherein said control point sensing means is a potentiometer.

14. The refrigerant compressor of claim 1, wherein said second valve means includes:

a casing; and a solenoid disposed in said casing.

15. The refrigerant compressor of claim 14, wherein said control signal is a ratio of solenoid energizing time to solenoid deeneergizing time.

16. The refrigerant compressor of claim 1, wherein said first valve control means controls the opening and closing of said first passageway in response to changes in suction chamber pressure.

17. The refrigerant compressor of claim 1, wherein said first valve control means controls the opening and closing of said first passageway in response to changes in discharge chamber pressure.

18. The refrigerant compressor of claim 1, wherein said shifting means shifts the control point of said valve element in response to pressure changes in said actuating chamber by applying a force to said valve element.

19. The refrigerant compressor of claim 1, wherein said air conditioning condition is the temperature of a passenger compartment air.

20. The refrigerant compressor of claim 1, wherein said air conditioning condition is the temperature of air leaving from an evaporator.

21. The slant plate compressor of claim 1, wherein said first valve means controls the opening and closing of said first passageway in response to changes in crank chamber pressure.

22. A slant plate type compressor with a capacity or displacement adjusting mechanism comprising:

a housing including a plurality of cylinders, a crank chamber, a suction chamber, a discharge chamber and an actuating chamber;

a plurality of pistons, each piston slidably fitted within each of said cylinders;

a drive mechanism including:

a drive shaft rotatably supported in said housing:

a member coupled to said drive shaft and having a surface with an adjustable incline angle, said incline angle controlled by pressure in the crank chamber and said member driving said pistons by reciprocating motion;

means for controlling the pressure in the crank chamber having a first passageway between said crank chamber and said suction chamber;

a first value control device at least partially disposed in said first passageway, including:

a valve element opening and closing said first passageway in response to a control point; and a shifting element having one end portion exposed in the actuating chamber and the other end portion coupled to said valve element, said shifting element shifts the control point of said valve element in response to changes in the pressure in the actuating chamber, wherein said actuating chamber is linked to both of said suction chamber and said discharge chamber via passageways and the volume of fluid flowing into said suction chamber from said actuating chamber is equal to or greater than the maximum volume of fluid flowing into said actuating chamber from said discharge chamber.

23. The slant plate type compressor of claim 22, wherein said valve element includes a bellows valve.

24. The slant type compressor of claim 22, wherein said actuating chamber is linked to both of said crank chamber and said discharge chamber via passageways and the volume of fluid flowing into said crank chamber from said actuating chamber is equal to or greater than the maximum volume of fluid flowing into said actuating chamber from said discharge chamber.

25. A slant plate type compressor with a capacity or displacement adjusting mechanism comprising:

a housing including a plurality of cylinders, a crank chamber, a suction chamber, a discharge chamber and an actuating chamber;

a plurality of pistons, each piston slidably fitted within each of said cylinders;

a drive mechanism including:

a drive shaft rotatably supported in said housing;

a member coupled to said drive shaft and having a surface with an adjustable incline angle, said incline angle controlled by pressure in the crank chamber and said member driving said pistons by reciprocating motion;

means for controlling the pressure in the crank chamber having a first passageway between said crank chamber and said suction chamber;

a first valve control device at least partially disposed in said first passageway, including:

a valve element opening and closing said first passageway in response to a control point; and a shifting element having one end portion exposed in the actuating chamber and the other end portion coupled to said valve element, said shifting element shifts the control point of said valve element in response to changes in the pressure in the actuating chamber;

second valve means, disposed in fluid communication with said actuating chamber, for controlling pressure in said actuating chamber;

means for sensing the control point of said valve element; and means for determining whether the control point of said valve element is changed or not on the basis of a sensed air conditioning condition signal and said sensed control point; and wherein said second valve means varies the pressure in said actuating chamber based on a control signal sent from said determining means.

26. The slant plate type compressor of claim 25, wherein said shifting element includes an actuating rod which transmits forces to said valve element in response to pressure received in said actuating chamber, with an axial location of said actuating rod substantially representing the control point of the suction chamber pressure and said axial location of said actuating rod being sensed by said sensing means.

27. The slant plate type compressor of claim 25, wherein said first valve device and said second valve means maintain a constant pressure at the outlet of an evaporator during capacity control of the compressor.

28. A slant plate type compressor with a capacity or displacement adjusting mechanism comprising:

a housing including a plurality of cylinders, a crank chamber, a suction chamber, a discharge chamber and an actuating chamber;

a plurality of pistons, each piston slidably fitted within each of said cylinders;

a drive mechanism including:

a drive shaft rotatably supported in said housing;

a member coupled to said drive shaft and having a surface with an adjustable incline angle, said incline angle controlled by pressure in the crank chamber and said member driving said pistons by reciprocating motion;

means for controlling the pressure in the crank chamber having a first passageway between said crank chamber and said suction chamber;

a first valve control device at least partially disposed in said first passageway, including:

a valve element opening and closing said first passageway in response to a control point; and a shifting element having one end portion exposed in the actuating chamber and the other end portion coupled to said valve element, said shifting element shifts the control point of said valve element in response to changes in the pressure in the actuating chamber;

wherein said shifting element further comprises a fourth passageway linking said actuating chamber to said suction chamber and a fifth passageway linking said actutating chamber to said discharge chamber; and said second valve means being disposed in said fifth passageway and controlling the closing and opening of said fifth passageway to vary pressure in said actuating chamber from the discharge chamber pressure to the suction chamber pressure.

29. The slant type compressor of claim 28, wherein said fourth passageway includes a throttled portion.

30. The slant type compressor of claim 29, wherein an opening area of said throttling portion is so sized and shaped as to equalize pressure in said actuating chamber relative to the discharge chamber pressure, when the communications of said fifth passageway is obtained.

31. A slant plate type compressor with a capacity or displacement adjusting mechanism comprising:

a housing including a plurality of cylinders, a crank chamber, a suction chamber, a discharge chamber and an actuating chamber;

a plurality of pistons, each piston slidably fitted within each of said cylinders;

a drive mechanism including:

a drive shaft rotatably supported in said housing;

a member coupled to said drive shaft and having a surface with an adjustable incline angle, said incline angle controlled by pressure in the crank chamber and said member driving said pistons by reciprocating motion;

means for controlling the pressure in the crank chamber having a first passageway between said crank chamber and said suction chamber;

a first valve control device at least partially disposed in said first passageway, including:

a valve element opening and closing said first passageway in response to a control point; and a shifting element having one end portion exposed in the actuating chamber and the other end portion coupled to said valve element, said shifting element shifts the control point of said valve element in response to changes in the pressure in the actuating chamber; and wherein said actuating chamber is linked to both of said crank chamber and said discharge chamber via passageways and the volume of fluid flowing into said crank chamber from said actuating chamber is equal to or greater than the maximum volume of fluid into said actuating chamber from said discharge chamber.

* * * * *